US005471714A

United States Patent [19]

Olson

[11] Patent Number: 5,471,714

[45] Date of Patent: Dec. 5, 1995

[54] DEVICE FOR ADJUSTABLE ATTACHMENT OF A STRAP

[75] Inventor: Ulf Olson, Gislaved, Sweden

[73] Assignee: Broderna Holmbergs Fabriks AB, Anderstorp, Sweden

[21] Appl. No.: 191,864

[22] Filed: Feb. 4, 1994

[51] Int. Cl.[6] ..... A44B 11/10

[52] U.S. Cl. ..... 24/171; 24/196

[58] Field of Search ..... 24/171, 194–197, 24/115 G

[56] References Cited

U.S. PATENT DOCUMENTS 3,999,254 12/1976 McLennan ..... 24/196

5,170,539 12/1992 Lundstedt et al. ..... 24/194 X

*Primary Examiner*—James R. Brittain

*Attorney, Agent, or Firm*—Merchant, Gould, Smith, Edell, Welter & Schmidt

[57] ABSTRACT

A device for adjustable attachment of a strap includes an injection moulded element forming an aperture therein. A cross bar forms an integral part of the element and extends across the aperture. An injection moulded plate has an opening and is integral with two spring legs diverging from an edge of the plate. The plate is mounted in the element which forms a cover at one side of the plate, and is displaceable in the element with the free ends of the spring legs engaging the element to bias an edge of the opening, substantially parallel to the cross bar, against a strap passed around the cross bar.

9 Claims, 2 Drawing Sheets

DEVICE FOR ADJUSTABLE ATTACHMENT OF A STRAP

BACKGROUND OF THE INVENTION

The invention relates to a device for adjustable attachment of a strap.

More particularly the invention relates to a device comprising a cross bar, a plate displaceable in relation to the cross bar transversely thereof, said plate forming an aperture with an edge substantially parallel to the cross bar, and a spring acting between the cross bar and the plate to press said edge against a strap passed around the cross bar.

Swedish Patent Specification No. 312 990 discloses a device wherein said plate comprises a lock tongue with flanged edge portions forming grooves wherein the cross bar is displaceably guided. A cover is detachably mounted to the lock tongue, and a spring blade is engaged between the cover and the cross bar. The prior art device thus consists of four parts. It is, however, desired to reduce the number of parts included in the device, in order to reduce the manufacturing costs, but also to reduce the dimensions of the device and to make the device small and light, particularly for use in the belts mounted on car seats for children.

SUMMARY OF THE INVENTION

The purpose of the invention is to satisfy these demands, and to provide a strap adjustment device which can be manufactured, mounted and handled in a very simple way.

For this purpose the invention provides a device of the kind referred to, comprising an injection moulded element having an aperture therein;

a cross bar forming an integral part of said element and extending across said aperture;

an injection moulded plate having an opening therein and mounted in said element with an edge of said opening substantially parallel to the cross bar, said plate being guided by said element for movement in relation to the cross bar transversely thereof, said element forming a cover for said plate; and a spring forming an integral part of said plate and comprising two diverging legs engaging said element at the free ends thereof to bias said plate towards said cross bar, pressing said edge against a strap passed around the cross bar.

BRIEF DESCRIPTION OF THE DRAWINGS

In order to explain the invention in more detail an embodiment thereof will be described below with reference to the accompanying drawings in which.

DETAILED DESCRIPTION OF THE PREFERRED EMBODIMENT

Figure 1:
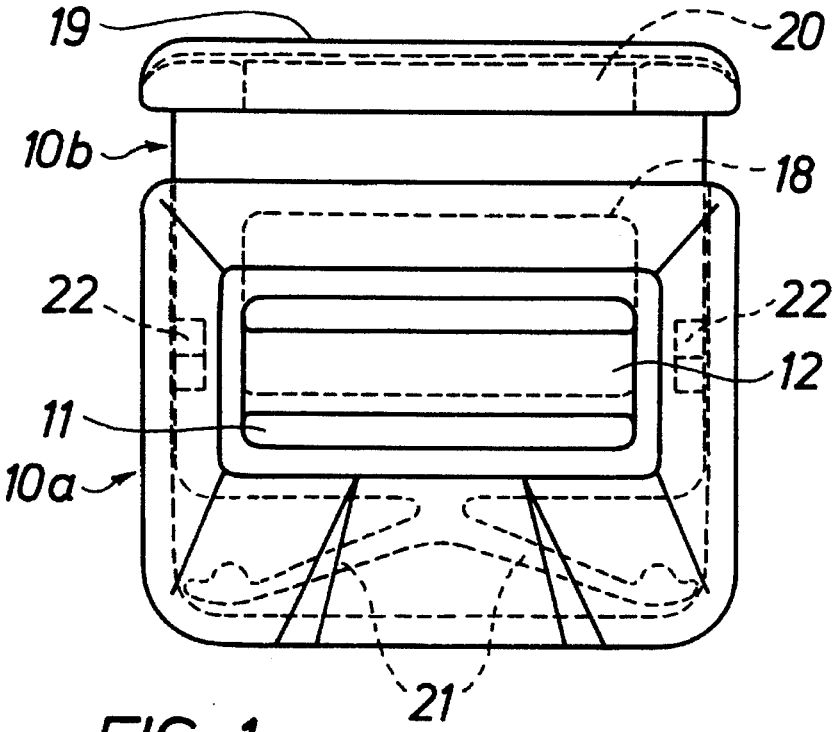
FIG. 1 is a side view of a device according to the invention intended for use in a belt for a car seat for children.

Two elements 10*a* and 10*b* are injection moulded of a suitable plastic material, e.g. Delrin 107®. One element 10*a* forms a rectangular aperture 11 and a cross bar 12 located centrally therein, which extends across the aperture in parallel with the two opposite longer side edges of the aperture. The side of the cross bar facing outwards is slightly set back in relation to the outside surface of the element and has gently curved edges as will be seen from FIG. 2. Along the two side edges of element 10*a* extending transversely of the cross bar, inwardly extending edge flanges 13 are provided which define two parallel side grooves 14 joining a bottom groove 15 in the element, which extends between the side grooves. Flanges 13 define at each side of the element a rectangular notch 16. Finally, element 10*a* also has a slot 17 at one side thereof at the end where bottom groove 15 is located.

The other element 10*b* comprises a rectangular plate which forms a rectangular opening 18 of the same length as aperture 11 but with slightly greater width than said aperture. At one end the plate forms a cross bar 19, a slot 20 being defined between said cross bar and one side of the plate, and at the other end the plate has two resiliently flexible spring legs 21 diverging from the center of the end edge of the plate and located in the same plane as the plate. The cross bar and the spring legs are integral with the plate. On the other side of the plate opposite to the cross bar 19 the plate forms two protrusions 22 terminating at the top thereof at a sharp edge 23 and at the bottom at a bevelled edge 24.

Figure 2:
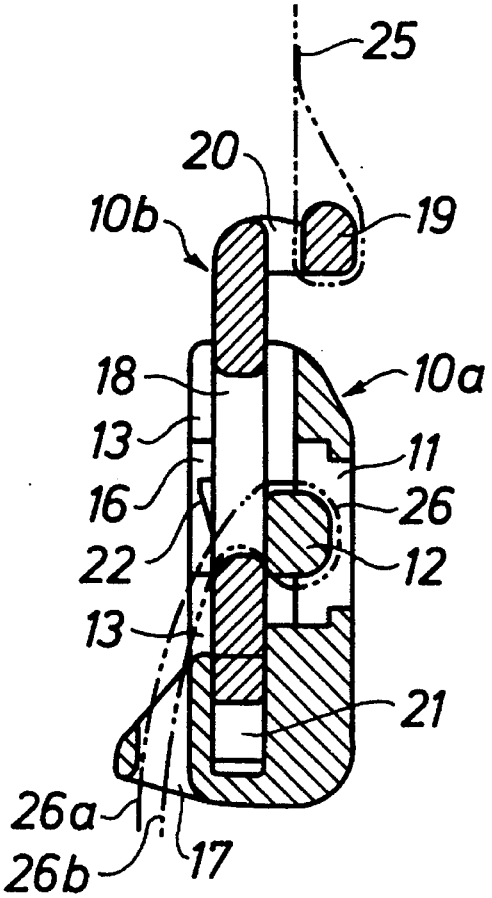
FIG. 2 is a vertical cross sectional view of the device.
Figure 3:
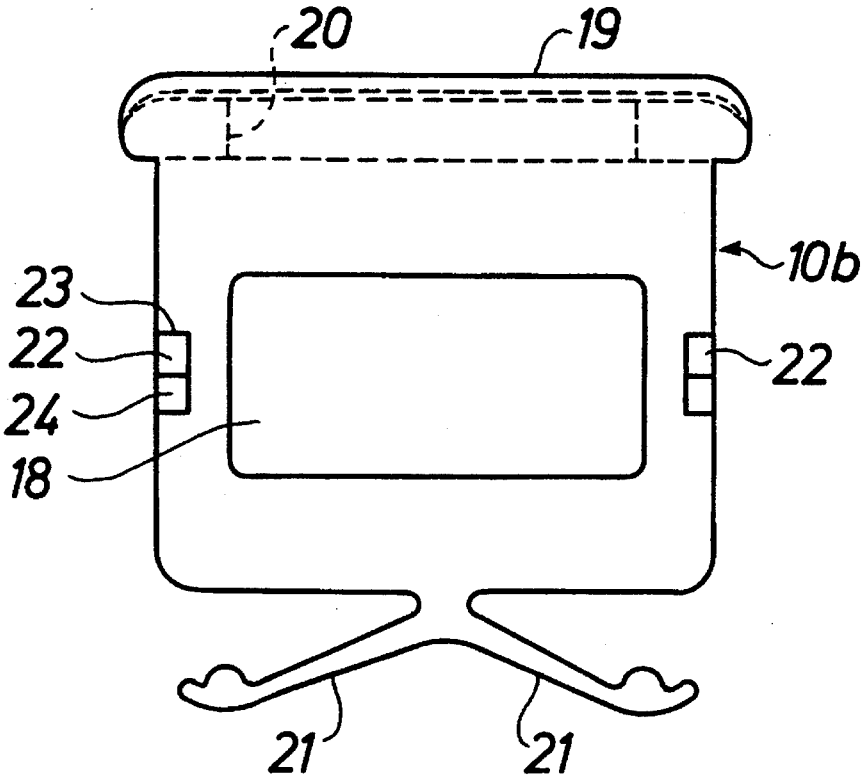
FIG. 3 is a side view of an element forming the plate and the spring.
Figure 4:
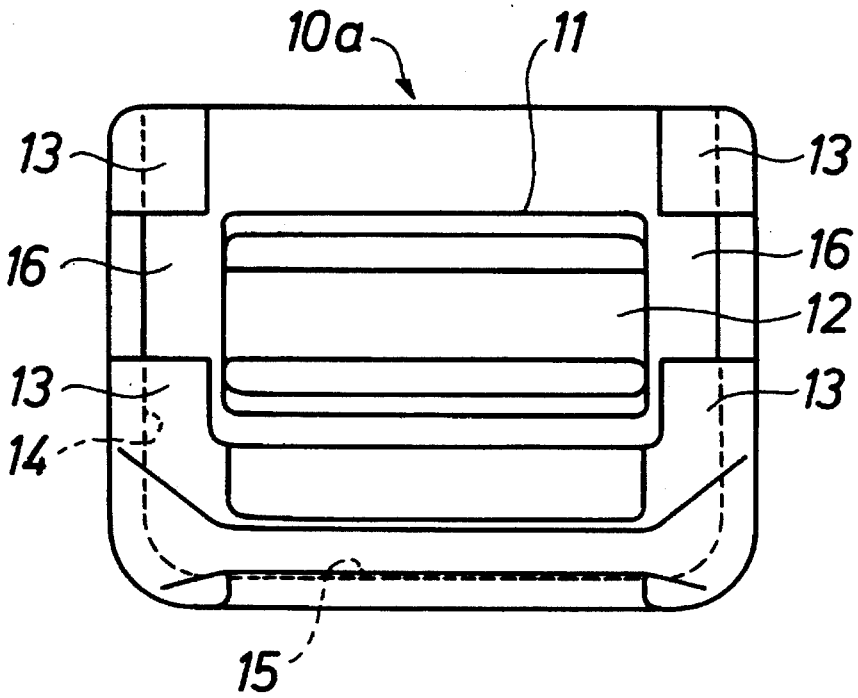
FIG. 4 is a side view of the element forming the cross bar and the cover.

Plate 10*b* is mounted in element 10*a* by being slid into side grooves 14 and bottom groove 15. Then, protrusions 22 slide beneath flanges 13 adjacent the upper edge of element 10*a*, said flanges being pressed outwards under resilient yielding by the bevelled edges 24 in order then to snap inwards behind the protrusions at the sharp edges 23 when the protrusions are received in the notches 16. Plate 10*b* cannot be withdrawn again from element 10*a* because the sharp edges 23 will engage the flanges 13. When thus mounted element 10*a* forms a cover on plate 10*b* at one side thereof. A limited displacement of plate 10*b* in relation to element 10*a* will be allowed because notches 16 have a greater length than protrusions 22. Spring legs 21 at the free ends thereof engage the bottom of groove 15, and when plate 10*b* is pressed into element 10*a* to the extent permitted by notches 16 and protrusions 22 such displacement will take place against the spring bias provided by spring legs 21. Normally plate 10*b* is kept in a position by the spring legs wherein the lower edge of opening 18 slightly overlaps cross bar 12 below as seen in FIGS. 1 and 2. This edge of the opening is gently curved.

When the strap adjustment device as described is being used a strap 25 is attached to plate 10*b* by said strap being passed through slot 20 and around cross bar 19 and being sewn together. This strap may form e.g. a shoulder strap of a belt for a car seat for children. A strap part 26*a* of a strap 26 forming part of the belt is attached to the car seat at the bottom thereof and is passed through slot 17 in element 10*a* and further through the opening 18 in plate 10*b* the strap then being passed around cross bar 12 of element 10*a* and again passed through opening 18 over the gently curved lower edge then to be passed as a strap part 26*b* through slot 17. Strap part 26*b* will hang as a loose strap end from the strap attachment device. By the spring bias of spring legs 21 the strap will be clamped against cross bar 12 at the lower edge of opening 18, and if a pull force is imparted to strap 25 and strap part 26*a* the clamping action will be increased so that strap 26 will be held immovably in the strap adjustment device. It is possible to tighten strap 26 i.e. to shorten the effective length thereof by pulling strap part 26*b*, plate 10*b* then being pressed away from the cross bar 12 at the lower edge of the opening 18 against the bias of spring legs 21, and it is also possible to increase the effective length of strap 26 by pulling strap part 26*a*. A larger force is required for this operation; it will be done more easily if plate 10*b* at the same time is pressed into element 10*a* against the bias of the spring legs.

The embodiment described can be modified by plate 10*b* being constructed as a lock tongue for co-operation with a strap buckle attached to strap 25.

I claim:

1. Device for adjustable attachment of a strap, comprising:

an injection moulded element having an aperture therein;

a cross bar forming an integral part of said element and extending across said aperture;

an injection moulded plate having an opening therein and mounted in said element with an edge of said opening substantially parallel to the cross bar, said plate being guided by said element for movement in relation to the cross bar transversely thereof, said element forming a cover for said plate; and a spring forming an integral part of said plate and comprising two legs diverging from a common joint on said plate and engaging said element at free ends thereof to bias said plate towards said cross bar, pressing said edge against a strap passed around the cross bar.

2. The device as in claim 1 wherein said element forms two side grooves and a bottom groove between said side grooves and wherein said plate is displaceably guided in said side grooves, and said legs engage a bottom of the bottom groove.

3. The device as in claim 2 wherein a recess is provided in a boundary wall of each of the side grooves, and wherein said plate forms a protrusion received by each said recess to limit displacement of the plate in said element.

4. The device as in claim 3 wherein each said protrusion forms a bevelled edge to allow said plate to be pushed into said element under resilient yielding of said boundary wall, and a sharp edge to prevent withdrawal of said plate from said element by said sharp edge engaging a boundary edge of each said recess.

5. Device for adjustable attachment of a strap, comprising;

an injection moulded element having an aperture therein;

a cross bar forming an integral part of said element and extending across said aperture;

an injection moulded plate having an opening therein and mounted in said element with an edge of said opening substantially parallel to the cross bar, said plate being guided by said element for movement in relation to the cross bar transversely thereof, said element forming a cover for said plate;

a spring forming an integral part of said plate and comprising two legs diverging from a common joint on said plate and engaging the element at free ends thereof to bias said plate towards said cross bar, pressing said edge against a strap passed around the cross bar, and a protrusion on said plate received by a recess formed by said element to limit displacement of the plate in the element.

6. The device as in claim 5 wherein said element forms two side grooves and a bottom groove between said side grooves and wherein said plate is displaceably guided in said side grooves, and said legs engage a bottom of the bottom groove, said recess being provided in a boundary wall of one of said side grooves.

7. The device as in claim 6 wherein said protrusion forms a bevelled edge to allow said plate to be pushed into said element under resilient yielding of said boundary wall, and a sharp edge to prevent withdrawal of said plate from said element by said sharp edge engaging a boundary edge of the recess.

8. Device for adjustable attachement of a strap, comprising:

an injection moulded element having an aperture therein;

a cross bar forming an integral part of said element and extending across said aperture;

an injection moulded plate having an opening therein and mounted in said element with an edge of said opening substantially parallel to the cross bar, said plate being guided by said element for movement in relation to the cross bar transversely thereof, said element forming a cover for said plate;

a spring forming an integral part of said plate and comprising two diverging legs engaging said element at free ends thereof to bias said plate towards said cross bar, pressing said edge against a strap passed around the cross bar;

wherein said element forms two side grooves and a bottom groove between said side grooves and wherein said plate is displaceably guided in said side grooves, and said legs engage a bottom of the bottom groove; and wherein a recess is provided in a boundary wall of each of the side grooves, and wherein said plate forms a protrusion received by each said recess to limit displacement of the plate in said element.

9. The device as in claim 8 wherein each said protrusion forms a bevelled edge to allow said plate to be pushed into said element under resilient yielding of said boundary wall, and a sharp edge to prevent withdrawal of said plate from said element by said sharp edge engaging a boundary edge of each said recess.

* * * * *